US007018239B2

(12) United States Patent
Zaderej et al.

(10) Patent No.: US 7,018,239 B2
(45) Date of Patent: Mar. 28, 2006

(54) SHIELDED ELECTRICAL CONNECTOR

(75) Inventors: Victor Zaderej, St. Charles, IL (US); Kent E. Regnier, Lombard, IL (US); David E. Dunham, Aurora, IL (US); Kevin Alberts, Naperville, IL (US); David Brearley, Jr., Naperville, IL (US)

(73) Assignee: Molex Incorporated, Lisle, IL (US)

( * ) Notice: Subject to any disclaimer, the term of this patent is extended or adjusted under 35 U.S.C. 154(b) by 909 days.

(21) Appl. No.: 09/767,190

(22) Filed: Jan. 22, 2001

(65) Prior Publication Data

US 2004/0097134 A1 May 20, 2004

(51) Int. Cl.
*H01R 13/648* (2006.01)

(52) U.S. Cl. ..... 439/608; 439/931

(58) Field of Classification Search ..... 439/608, 439/931, 732, 701, 731
See application file for complete search history.

(56) References Cited

U.S. PATENT DOCUMENTS

| | | | | |
|---|---|---|---|---|
| 4,921,453 | A | | 5/1990 | Obrien |
| 4,969,827 | A | | 11/1990 | Hahs, Jr. |
| 4,969,842 | A | | 11/1990 | Davis |
| 5,028,492 | A | | 7/1991 | Guenin |
| 5,061,198 | A | | 10/1991 | Manabe et al. |
| 5,344,341 | A | | 9/1994 | Yoshino |
| 5,354,219 | A | | 10/1994 | Wanjura |
| 5,545,051 | A | * | 8/1996 | Summers et al. ..... 439/350 |
| 5,599,595 | A | | 2/1997 | McGinley et al. |
| 5,626,483 | A | | 5/1997 | Naitoh |
| 5,688,146 | A | | 11/1997 | McGinley et al. |
| 5,713,762 | A | * | 2/1998 | Mitra et al. ..... 439/607 |
| 5,718,606 | A | | 2/1998 | Rigby |
| 5,727,956 | A | | 3/1998 | Mitra |
| 5,743,765 | A | | 4/1998 | Andrews et al. |
| 6,375,506 | B1 | | 4/2002 | Saunders et al. |
| 6,375,512 | B1 | | 4/2002 | Zito et al. |
| 6,491,545 | B1 | | 12/2002 | Spiegel et al. |
| 6,702,590 | B1 | | 3/2004 | Zaderej et al. |
| 2002/0142629 | A1 | | 10/2002 | Zaderej et al. |

FOREIGN PATENT DOCUMENTS

| | | |
|---|---|---|
| EP | 0 510 995 A2 | 10/1992 |
| EP | 0 693 795 | 1/1996 |
| EP | 0 969 567 A1 | 1/2000 |
| EP | 1 017 134 A2 | 7/2000 |
| GB | 2312566 A | 10/1997 |

OTHER PUBLICATIONS

International Search Report, Mailed Dec. 5, 2002.
International Search Report in PCT Counterpart Application, No. PCT/US02/01807.

* cited by examiner

*Primary Examiner*—Phuong Dunh
(74) *Attorney, Agent, or Firm*—Thomas D. Paulius

(57) ABSTRACT

A shielded electrical connector is provided for mounting on a printed circuit board. The connector includes a dielectric housing having a plurality of terminal-receiving cavities and a plurality of board-engaging pads projecting from the bottom of the housing. A plurality of terminals are received in the cavities. Portions of the housing between the terminals are plated with conductive metal material to electrically shield the terminals from each other and to provide a controlled impedance. The plating is continuous onto the pads for connection to appropriate ground circuit means on the printed circuit board. In an alternative embodiment, a shielded electrical connector assembly includes a pair of connectors both of which have plated housings with interengaging plated portions.

18 Claims, 9 Drawing Sheets

FIG. 12
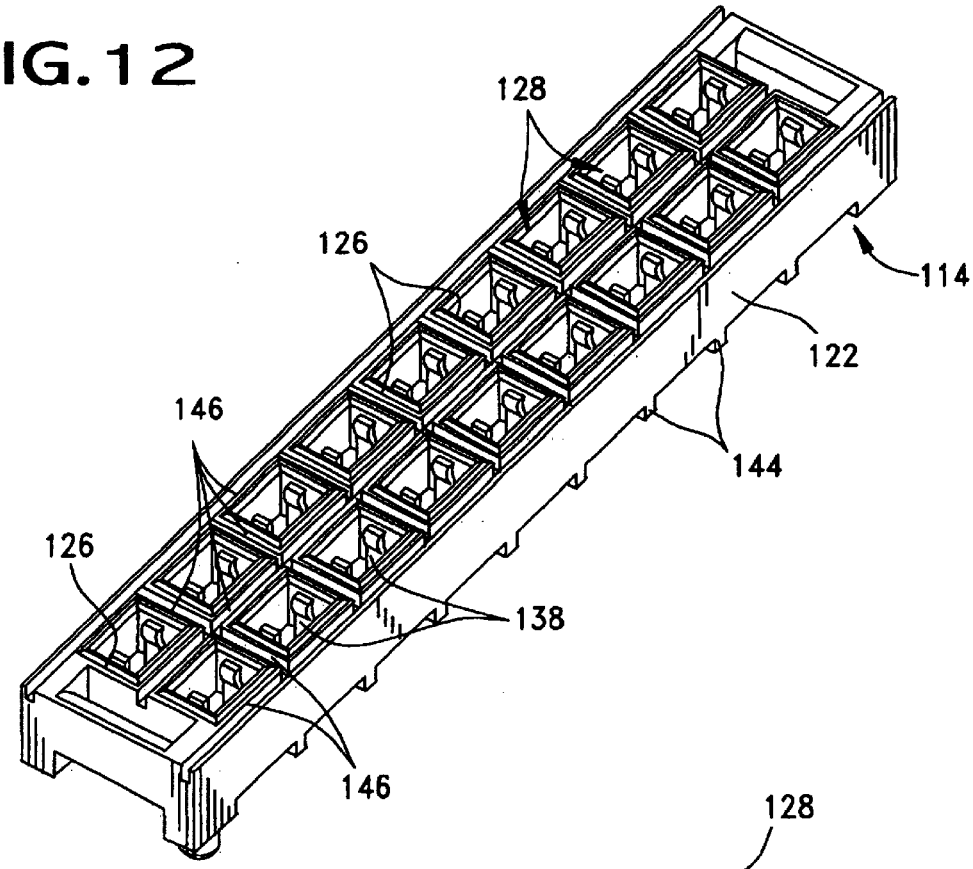
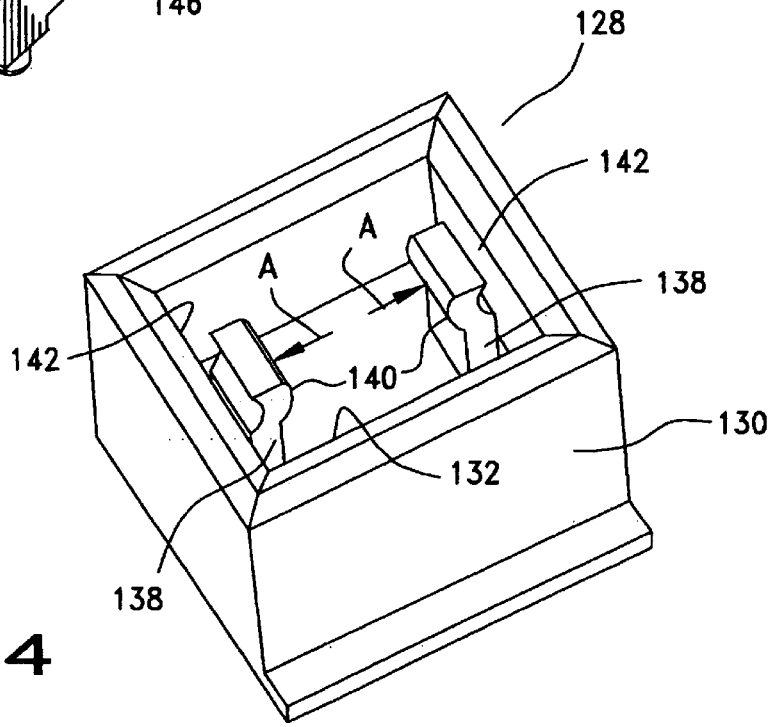
FIG. 14

FIG. 15
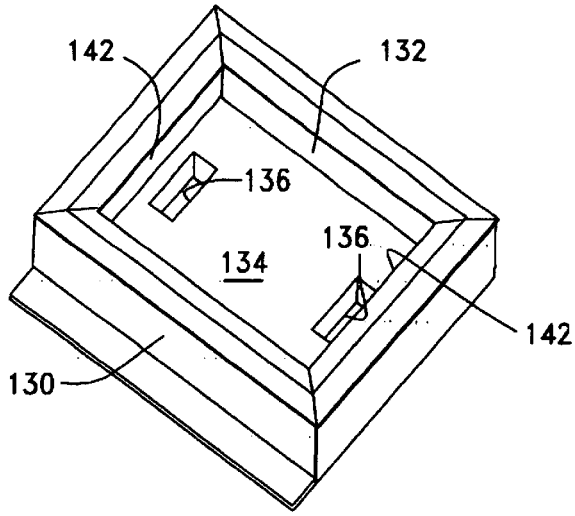
FIG. 17
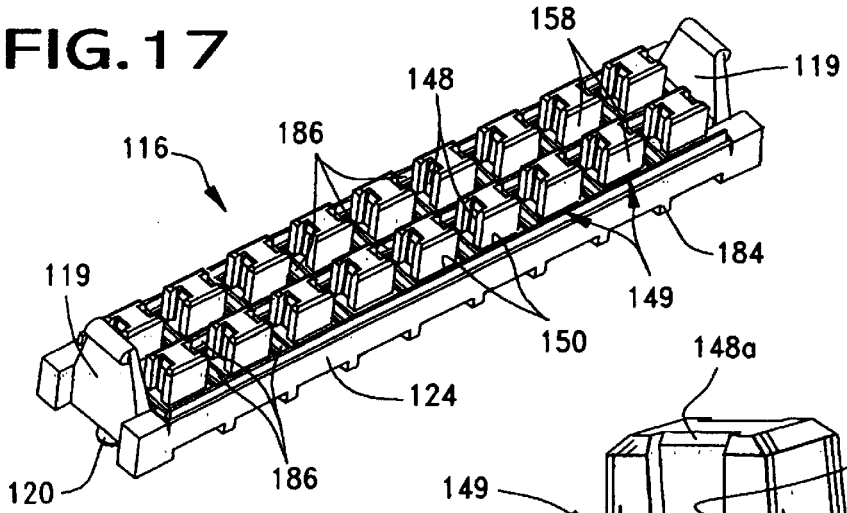
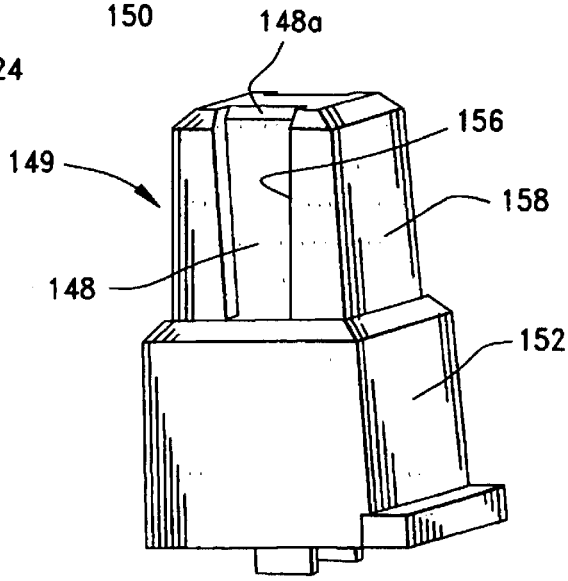
FIG. 19

FIG. 18
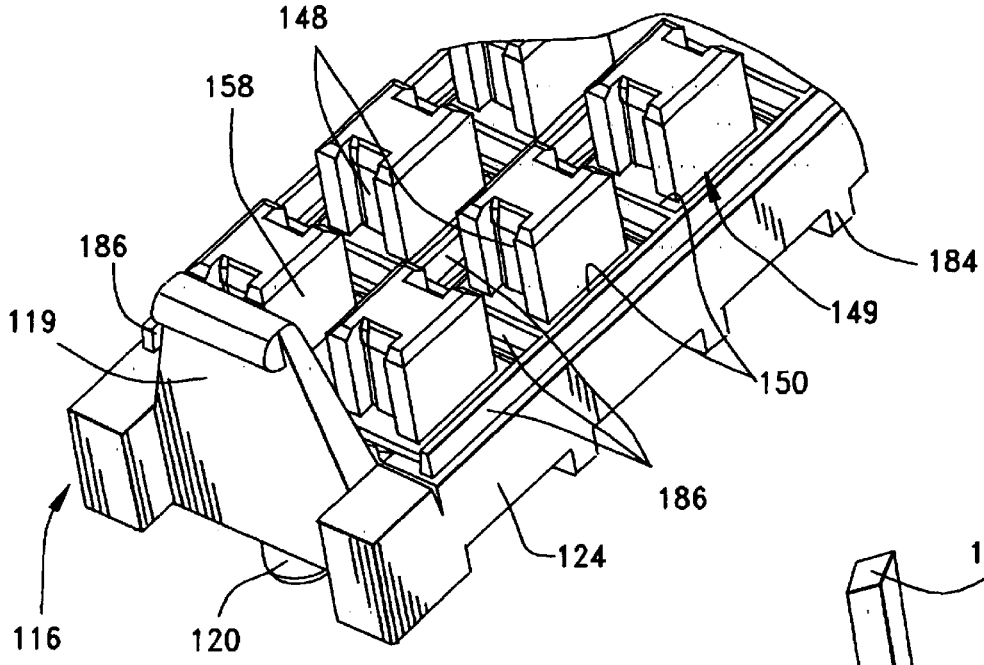
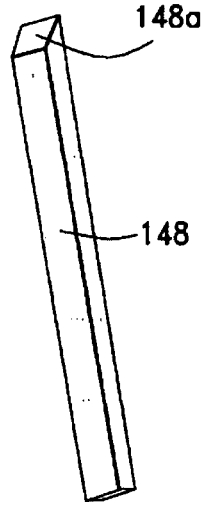
FIG. 21
FIG. 20
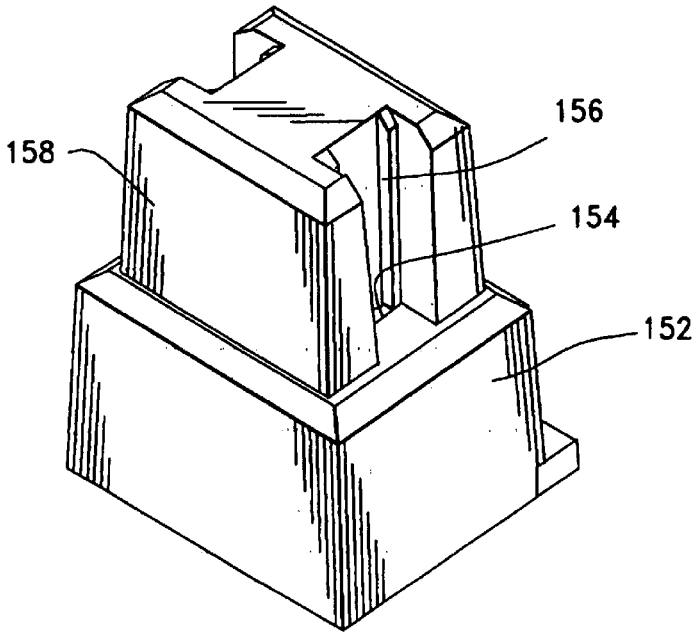

SHIELDED ELECTRICAL CONNECTOR

FIELD OF THE INVENTION

This invention generally relates to the art of electrical connectors and, particularly, to shielded electrical connectors which are particularly useful for mounting on printed circuit boards and for interconnecting parallel printed circuit boards.

BACKGROUND OF THE INVENTION

Dramatic changes are occurring in the wireless, switching and networking industries which are creating a need to transmit information at an ever-increasing rate. For instance, Internet content is expected to be received by cell phones, notebook computers and the like without the need for wires and with considerable speed. In many applications, the challenge is to increase data rates between circuit boards and cables. As the speed and frequency of these devices increase, all of the components within a system must be capable of performing at those speeds. This, in turn, creates challenges with respect to "noise" and interference between the devices. Therefore, it is necessary to isolate or shield the signals from each other by placing an electrical shield between the signals. Heretofore, many electrical connectors have used terminal arrays which have signal terminals alternating with significantly sized shielding or ground terminals along the entire length of the terminal array. Of course, this approach significantly increases the sizes of the electrical connectors in high speed applications where miniaturization is a constant goal.

Electrical connectors often are mounted on printed circuit boards where the "real estate" on the boards is a premium. A "mezzanine" connector assembly provides electrical interconnection between parallel circuit boards. Mezzanine boards are frequently used where more function is needed than will fit on the primary board. Mezzanine boards also facilitate system partitioning necessary to offer multiple options and expandability. The connector assembly must be capable of operating at the same high data rates as the primary and mezzanine boards. The signals in such arrangements or systems must be electrically shielded or isolated so that the connector assembly has very low cross-talk between the signal lines.

Frequently, high speed mezzanine connectors must transmit differential pair signals, requiring that two signals or terminals are spaced within one cavity so that they are electrically coupled to significantly reduce the common mode noise and to electrically shield or isolate these differential pairs from each other.

The present invention is directed to solving these various problems and providing a simple and very efficient and effective shielding system in electrical connectors, such as connectors which are mounted on printed circuit boards.

SUMMARY OF THE INVENTION

An object, therefore, of the invention is to provide a new and improved shielded electrical connector of the character described.

Another object of the invention is to provide a new and improved shielded electrical connector particularly adapted for mounting on a printed circuit board.

A further object of the invention is to provide a new and improved shielded connector assembly including two mating connectors having a common shield running therethrough.

In one embodiment of the invention, a shielded electrical connector includes a dielectric housing having a plurality of terminal-receiving cavities and a plurality of board-engaging pads projecting from the bottom of the housing. A plurality of terminals are received in the cavities in the housing. Portions of the housing between the terminals are plated with conductive metal material to electrically shield the terminals from each other. The plating is continuous onto the board-engaging pads for connection to appropriate ground circuit means on the printed circuit board.

As disclosed herein, the housing is molded of dielectric plastic material, with the board-engaging pads being molded integrally therewith. The pads are located between the terminal-receiving cavities. Substantially the entire housing, including the board-engaging pads, is plated with the conductive metal material, with the terminals being insulated therefrom.

According to one aspect of the invention, the board-engaging pads are configured for surface engaging the printed circuit board. In addition, the terminals include portions adapted for surface connection to appropriate circuit means on the printed circuit board. Although the invention is not limited to such configurations, this avoids having to drill large holes in the printed circuit board.

According to another aspect of the invention, the terminals comprise elements of terminal modules. Specifically, the terminals are mounted in respective dielectric blocks received in the terminal-receiving cavities of the housing. The dielectric blocks may be overmolded about portions of the terminals. In the preferred embodiment, the terminals are mounted in pairs, with one pair in each terminal-receiving cavity. At least portions of the housing between the cavities are plated with the conductive metal material, running to the plated board-engaging pads.

In a second embodiment of the invention, a shielded electrical connector assembly includes first and second shielded connectors. Both connectors have dielectric housings with terminal-receiving cavities mounting respective terminals. The two housings of the two connectors have complementary interengaging portions. Portions of both housings are plated with conductive metal material to shield the respective terminals from each other. The metal plating on the two housings run continuously onto the complementary interengaging portions to conductively common the shielding between both the first and second connectors.

In the second embodiment, the complementary interengaging portions between the two housings of the two connectors comprise a tongue-and-groove structure. Specifically, a network of ribs on the housing of one of the connectors interengage within a network of grooves in the housing of the other connector. The interengaging ribs and grooves extend between the respective terminals of the two connectors.

Like the first embodiment, the housings of the two connectors in the second embodiment include integrally molded board-engaging pads which also are plated with the conductive metal material, the pads being configured for surface connection to appropriate circuit means on printed circuit boards. The connectors of the connector assembly in the second embodiment also include terminal modules having respective terminals mounted in dielectric blocks received in the terminal-receiving cavities of the housings of the two connectors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 12 is a perspective view looking at the mating face of the primary connector of the assembly show in FIG. 10;

FIG. 14 is a perspective view of one of the terminal modules of the primary connector shown in FIG. 12;

FIG. 15 is a perspective of the body of the terminal module of FIG. 14;

FIG. 17 is a perspective looking at the mating face of the mating connector in the connector assembly of FIG. 10;

FIG. 18 is a fragmented, enlarged perspective view of a portion of the mating face shown in FIG. 17;

FIG. 19 is a perspective view of one of the terminal modules in the mating connector of FIG. 17;

FIG. 20 is a perspective view of the body of the terminal module of FIG. 19; and FIG. 21 is a perspective view of one of the terminals in the module of FIG. 19.

DETAILED DESCRIPTION OF THE PREFERRED EMBODIMENT

Figure 1:
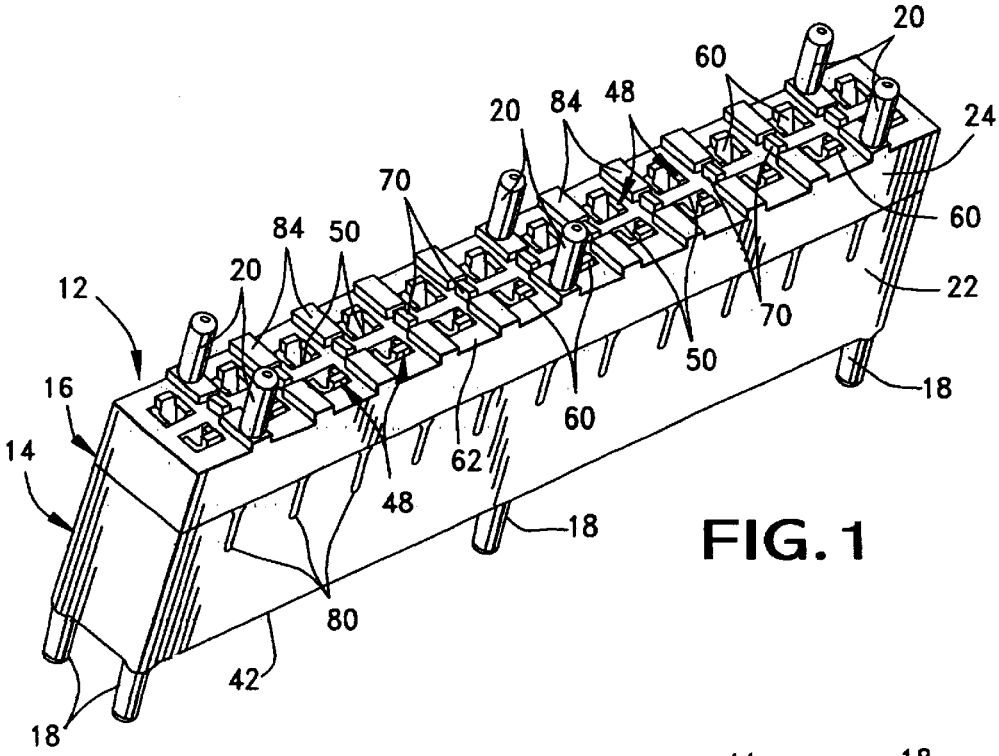
FIG. 1 is a perspective view of one embodiment of a connector assembly, including a primary connector and a mating connector, incorporating the concepts of the invention.

Referring to the drawings in greater detail, FIGS. 1–9 show a first embodiment of a connector assembly incorporating the concepts of the invention, and FIGS. 10–21 show a second embodiment of a connector assembly also incorporating the concepts of the invention. Referring to the first embodiment of FIGS. 1–9, and first to FIGS. 1 and 2, the invention is incorporated in an electrical connector assembly, generally designated 12, which includes a first or primary connector, generally designated 14, and a second or mating connector, generally designated 16. The connector assembly is a "mezzanine" connector assembly in that it is provided for electrically interconnecting two parallel printed circuit boards. To that end, it can be seen that primary connector 14 includes a plurality of mounting posts 18 for insertion into appropriate mounting holes in a first printed circuit board (not shown) which may be a main or motherboard. Mating connector 16 includes a plurality of mounting posts 20 for insertion into a plurality of mounting holes in a second printed circuit board (not shown) which may be a smaller or daughterboard. Mounting posts 18 project from a housing 22 of primary connector 14 and mounting posts 20 project in an opposite direction from a housing 24 of mating connector 16. Therefore, connector assembly 12 is sandwiched between two parallel circuit boards when properly mounted. The circuit boards are not shown in the drawings in order to avoid unduly cluttering or complicating the depictions.

Figure 2:
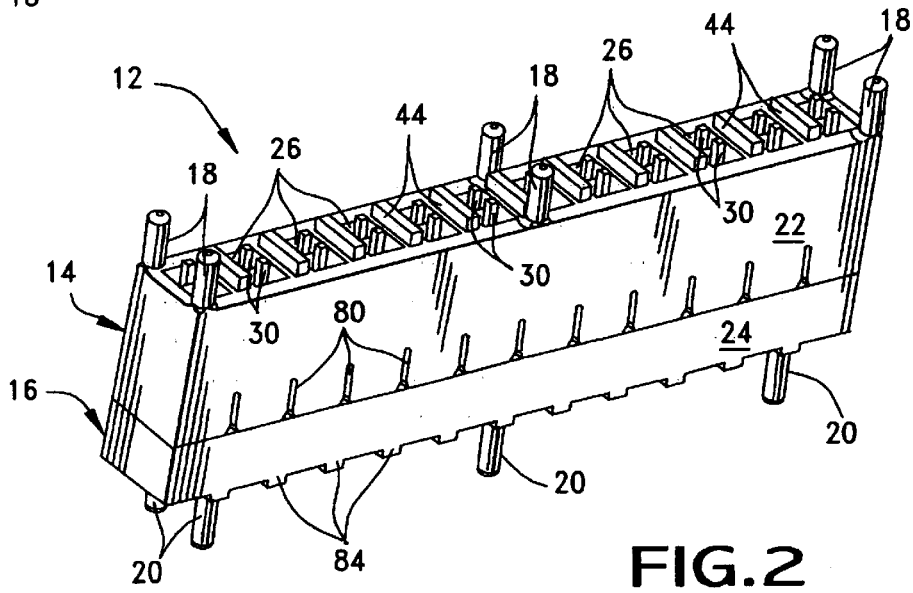
FIG. 2 is a perspective view of the connector assembly looking at the bottom of the assembly as viewed in FIG. 1.
Figure 3:
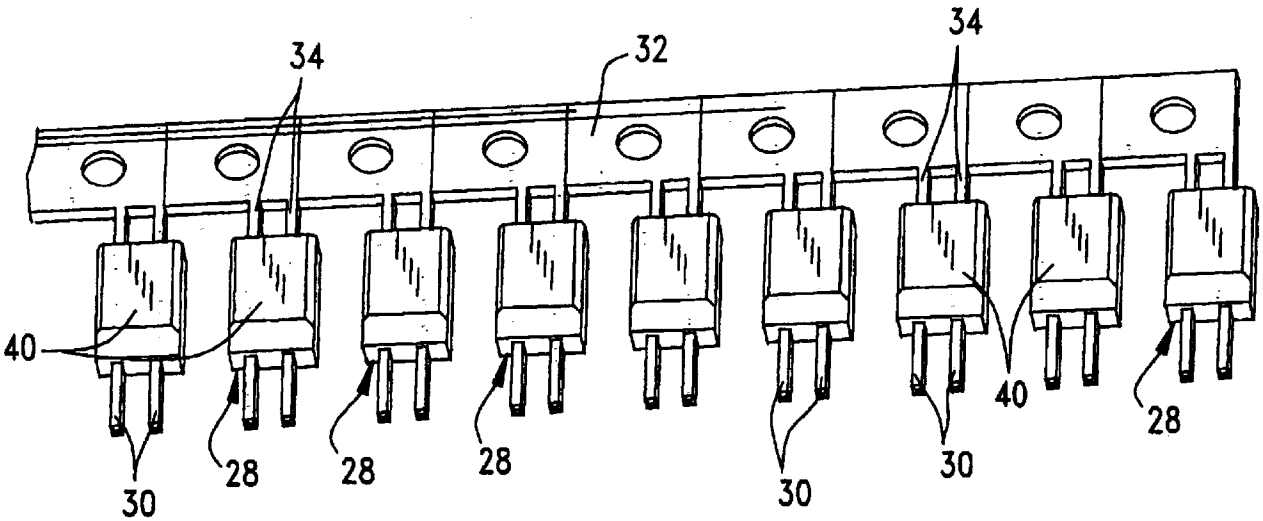
FIG. 3 is a perspective view showing a plurality of terminal modules during processing, the modules being mounted within the primary connector of the assembly of FIGS. 1 and 2.
Figure 4:
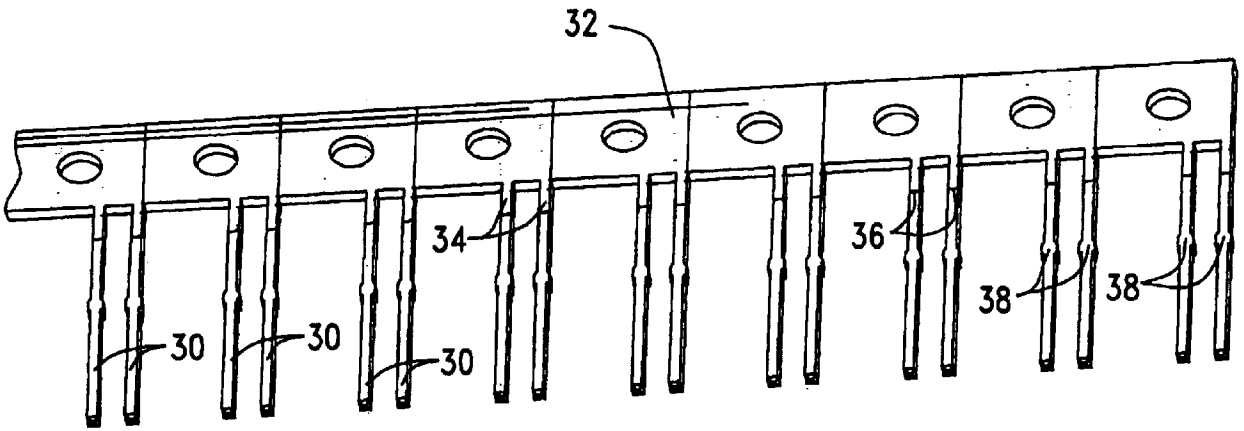
FIG. 4 is a perspective view of the terminals during processing, for the modules of FIG. 3.
Figure 5:
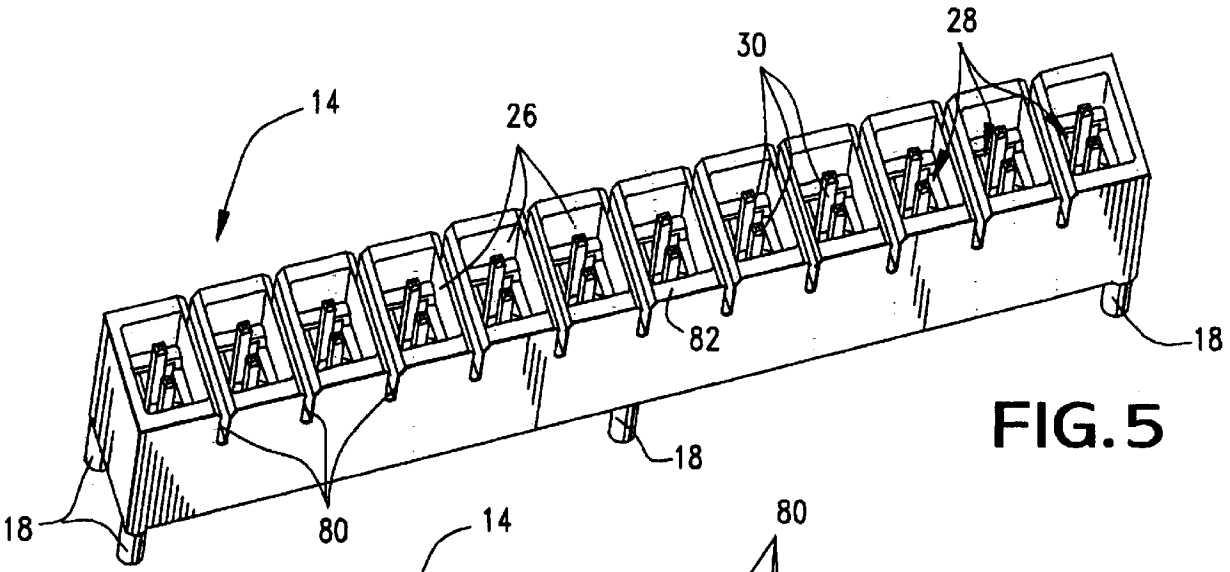
FIG. 5 is a perspective view looking at the mating face of the primary connector which mounts the terminal modules of FIG. 3.
Figure 6:
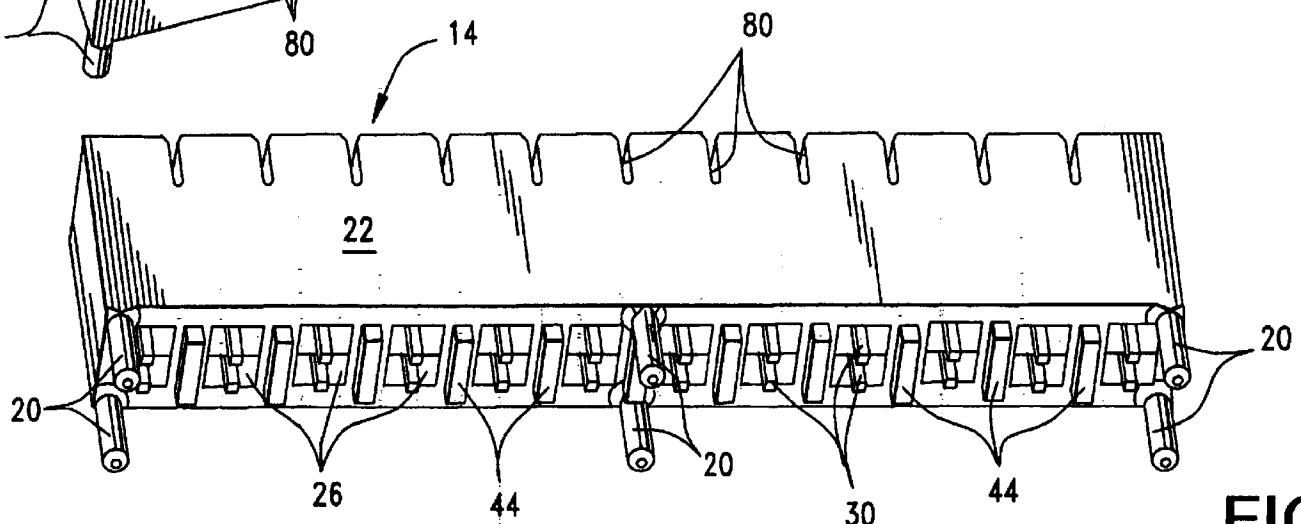
FIG. 6 is a perspective view looking at the terminating face of the primary connector.

Referring to FIGS. 3–6 in conjunction with FIG. 2, housing 22 of primary connector 14 is provided with a plurality of terminal-receiving cavities 26 for receiving a plurality of terminal modules, generally designated 28 and shown best in FIG. 3. The terminal modules are fabricated by first stamping a plurality of pairs of signal terminals 30 from conductive sheet metal material as seen in FIG. 4. The signal terminals are shown in FIG. 4 still attached to a carrier strip 32 by means of webs 34 of metal material. Carrier strip 32 carries the terminals through the processing stations for terminal modules 28. Eventually, the terminals (i.e., modules) will be severed along severing lines 36 (FIG. 4). The terminals have enlarged sections 38 to facilitate holding the terminals within their respective modules.

After the signal terminals are stamped as shown in FIG. 4, dielectric blocks 40 of plastic material are overmolded about the terminals including enlarged sections 38 thereof. The modules then are severed from carrier strip 32 and appropriately inserted or mounted within terminal-receiving cavities 26 of housing 22 of primary connector 14. As best seen in FIG. 2, terminals 30 project from a terminating or board-mounting face 42 of housing 22 for surface connection, as by soldering, to appropriate circuit means or traces on the main printed circuit board.

As best seen in FIG. 2, housing 22 of primary connection 14 includes a plurality of standoffs or board-engaging pads 44 which project from terminating face 42 of the housing. It can be seen that the pads are elongated to span the width of signal terminal pairs 30 and are alternatingly disposed between the pairs lengthwise of the connector. In other words, the board-engaging pads are disposed between terminal-receiving cavities 26 of the connector housing. The bottom surfaces of the pads are flush or coplanar with the bottom ends of signal terminals 30 for surface mounting of the pads to the main circuit board, as described hereinafter.

As stated above and described in relation to FIGS. 2–4, signal terminals 30 of terminal modules 28 which are respectively mounted within terminal-receiving passages 26 of primary connector 14, are arranged in pairs lengthwise of the connector. Electrically, this is a differential pair connector design in which two signals are spaced such that they are electrically coupled in order to significantly reduce the common noise within their signals. The coupling allows the optimization of bandwidth. The noise or cross-talk between signal pairs is greatly reduced by the invention, as described below. However, the invention is not limited to differential pair designs, and may include other terminal configurations such as where there is only one terminal per module or where certain of the terminal modules may include signal terminals and other of the terminal modules may include power terminals.

More particularly, the invention contemplates that housing 22 of primary connector 14 be plated with conductive metal material to electrically shield the terminals (pairs) from each other. It is contemplated that the plating be continuous along the housing and onto board-engaging pads 44 seen best in FIGS. 2 and 6. Minimally, the housing is plated between the terminals, such as within cavities 26, and onto the board-engaging pads. In the preferred embodiment, the entire housing 22, including the interior of cavities 26 and the exterior of pads 44, along with mounting posts 18, is plated with the conductive metal material. This provides a total shielding environment about signal terminals 30. When the signal terminals are surface connected, as by soldering, to appropriate circuit means or traces on the main printed circuit board, board-engaging pads are connected, as by soldering, to appropriate ground circuit means or traces on the printed circuit board. Plated mounting posts 18 may also be connected to appropriate ground circuits on the board. Therefore, the entire housing not only completely shields the pairs of signal terminals 30 from each other, but the housing is totally grounded to the ground means of the main printed circuit board.

Figure 7:
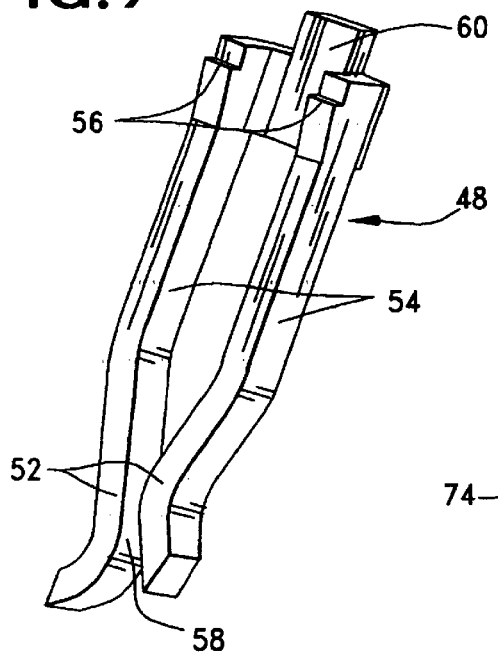
FIG. 7 is a perspective view of one of the signal terminals mounted in the mating connector of the assembly of FIGS. 1 and 2.

FIG. 7 shows one of a plurality of signal terminals, generally designated 48, which are mounted in a plurality of terminal-receiving cavities 50 (FIG. 1) through housing 24 of mating connector 16. Each terminal 48 includes a bifurcated mating end defined by a pair of contacts 52 at the distal ends of a pair of resilient contact arms 54. The terminals are press-fit into cavities 50, and the terminals have barbs 56 for holding the terminals in the cavities. Spaced contacts 52 of contact arms 54 define a mouth, generally designated 58, therebetween, for receiving and electrically engaging one of the signal terminals 30 of primary connector 14. A terminating tail 60 projects from the opposite end of each terminal 48. Tails 60 project from a terminating face 62 of housing 24 of mating connector 16 as seen in FIG. 1. Terminals 48 are mounted within cavities 50 in pairs lengthwise of housing 24, corresponding to the differential pairs of terminals 30 of primary connector 14.

Figure 8:
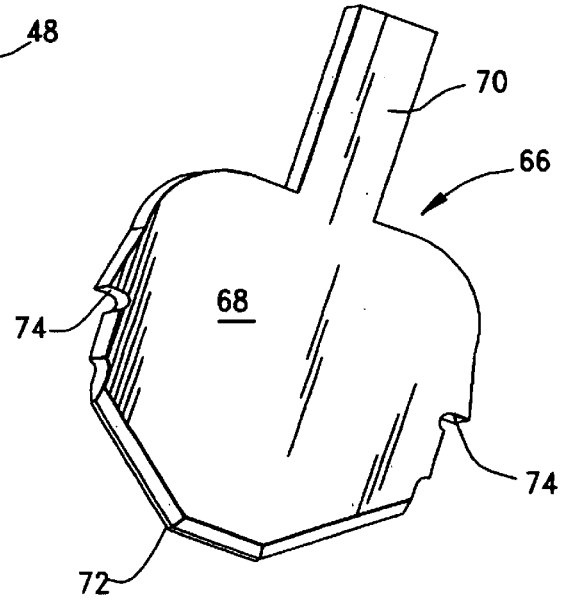
FIG. 8 is a perspective view of one of the ground members mounted in the mating connector.

FIG. 8 shows one of a plurality of ground members, generally designated 66, which are mounted through housing 24 of mating connector 16. One ground member 66 is alternatingly mounted between the pairs of terminals 48 lengthwise of housing 24. Specifically, each ground member includes a body 68, a tail 70 at one end of the body and an angularly truncated edge 72 at the opposite end of the body. The body has barbs 74 at opposite edges thereof for facilitating mounting the ground member within passages in housing 24. FIG. 1 shows tails 70 of the ground members projecting from terminating face 62 of housing 24. The tails extend the same distance from the mating face as terminating tails 60 of terminals 48, whereby all of the tails of the terminals and the ground members are surface connected, as by soldering, to signal circuit means and ground circuit means, respectively, on the daughter circuit board.

Figures 9, 13:
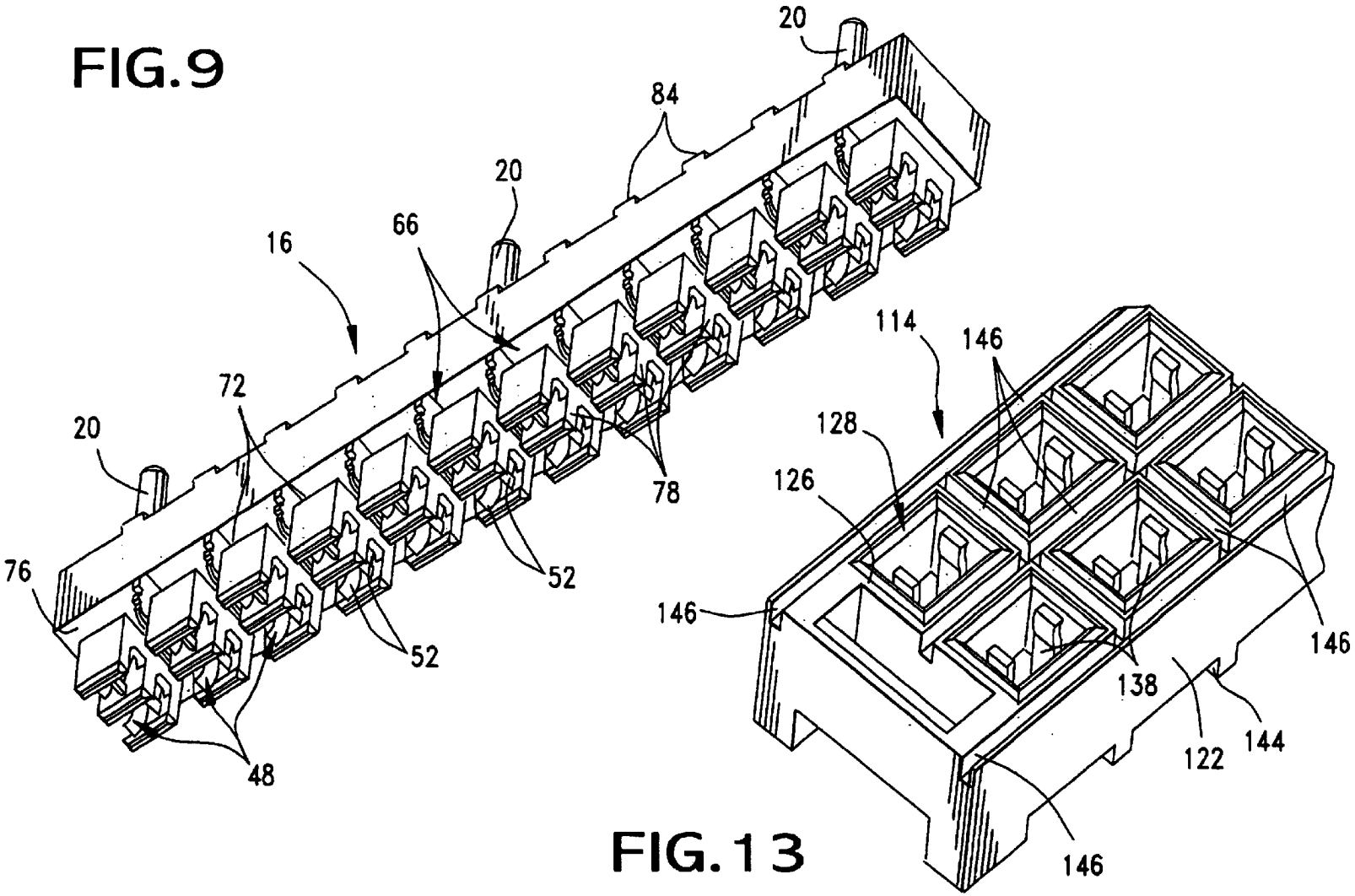
FIG. 9 is a perspective view looking at the mating face of the mating connector.
FIG. 13 is a fragmented, enlarged perspective view of a portion of the mating face in FIG. 12.

FIG. 9 shows how angled truncated edges 72 of ground members 66 project from a mating face 76 of housing 24 of mating connector 16. FIG. 9 also shows how contacts 52 of terminals 48 extend into a plurality of blocks 78 formed integrally with the housing and projecting from mating face 76. Referring back to FIG. 5, housing 22 of primary connector 14 includes a plurality of slots 80 in a mating face 82 between cavities 26. When the connectors are mated such that mating face 76 of mating connector 16 abuts mating face 82 of primary connector 14, blocks 78 of the mating connector move into cavities 26 of the primary connector, whereupon signal terminals 30 are engaged within contacts 52 of terminals 48. In addition, edges 72 of ground members 66 of the mating connector move into slots 80 of the primary connector with a press-fit so that the edges engage the sides of the slots. With housing 22 of the primary connector being plated with the conductive metal material, ground members 66 of the mating connector are interengaged with the grounded plating about the housing of the primary connector, thereby not only commoning the grounds of the two connectors but commoning the parallel circuit boards to which the connectors are mounted and respectively grounded. It can be understood that a complete grounding system from one circuit board to the other circuit board is achieved by ground members 66 of mating connector 16 and the conductive plating about housing 22 of primary connector 14.

Figure 10:
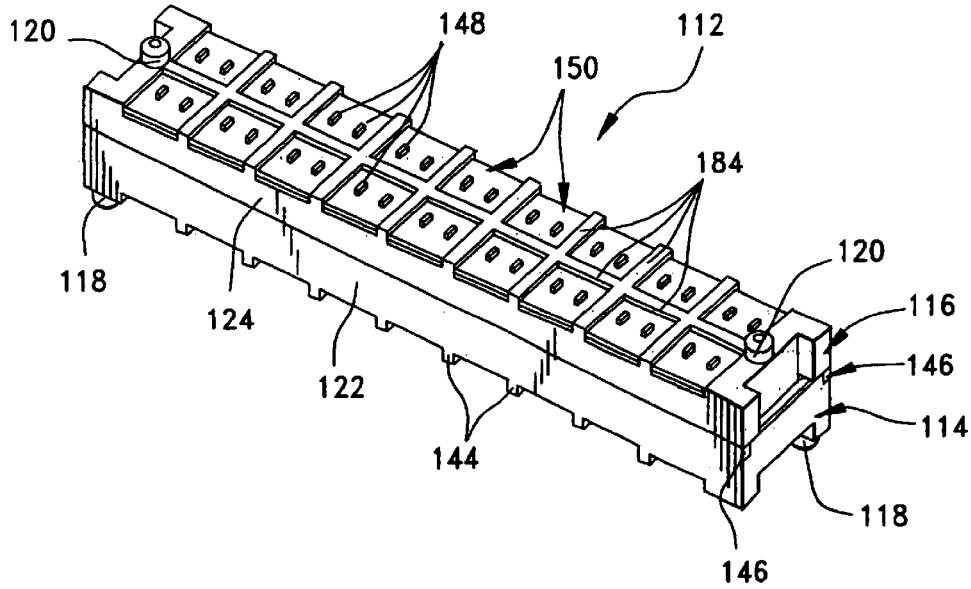
FIG. 10 is a perspective view of a second embodiment of a connector assembly incorporating the concepts of the invention.
Figures 11, 16:
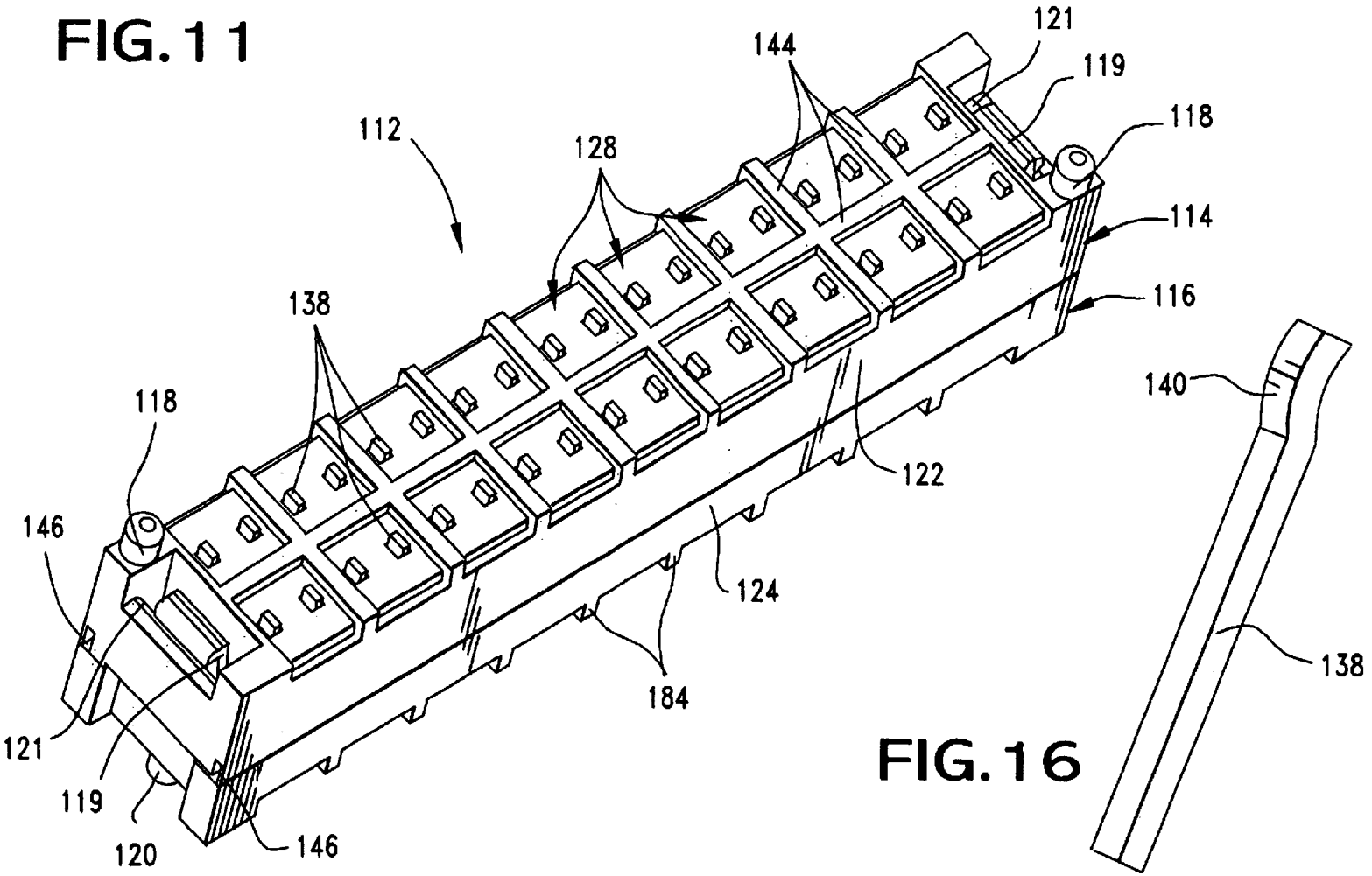
FIG. 11 is a perspective view of the connector assembly looking at the bottom of the assembly as viewed in FIG. 10.
FIG. 16 is a perspective view of one of the terminals in the module of FIG. 14.

As stated above, a second embodiment of the invention is shown in FIGS. 10–21. Referring first to FIGS. 10 and 11, an electrical connector assembly, generally designated 112, includes a first or primary connector, generally designated 114, and a second or mating connector, generally designated 116. Like the first embodiment, connector assembly 112 is a "mezzanine" connector assembly for electrically interconnecting two parallel printed circuit boards. Therefore, primary connector 114 includes a plurality of mounting posts 118 and mating connector 116 includes a plurality of mounting posts 120. As seen best in FIG. 11, mating connector 116 has a pair of flexible latch arms 119 at opposite ends thereof for snap-latching engagement with latch shoulders 121 on primary connector 114 to hold the connectors latched in mating condition as shown. Primary connector 114 includes a housing 122, and mating connector 116 includes a housing 124.

Referring to FIGS. 12 and 13 in conjunction with FIGS. 10 and 11, housing 122 of primary connector 114 is provided with a plurality of terminal-receiving cavities 126 for receiving a plurality of terminal modules, generally designated 128. FIG. 14 shows one of the terminal modules 128 removed from the connector. Each terminal module includes a dielectric body 130 defining a receptacle 132. The body is shown isolated in FIG. 15 and includes a wall 134 at the bottom of receptacle 132. The wall has a pair of through holes 136 which mount a pair of signal terminals 138. One of the terminals is shown in FIG. 16, and it can be seen that each signal terminal is a blade-like structure having a convex contact end 140. FIG. 14 shows that the convex contacts ends 140 of the terminals face each other across receptacle 132. The receptacle has a pair of side walls 142 which are spaced a distance behind blade terminals 138 to allow the terminals to flex in the direction of arrows "A" (FIG. 14). However, walls 142 provide an anti-overstress means backing the terminals when the two connectors are mated and the terminals engage the terminals of mating connector 116, described below.

Referring back to FIGS. 10–12, like the first embodiment, housing 122 of primary connector 114 includes a plurality of standoffs or board-engaging pads 144 which are arranged in an interconnecting grid as seen best in FIG. 11. In essence, pads 144 are in a pattern to extend crosswise and lengthwise of the housing between all adjacent terminal modules 128. Also as with the first embodiment, FIG. 11 shows that terminals 138 and pads 144 extend from housing 122 of primary connector 114 so that both the terminals and the pads are flush or coplanar with each other for surface connection, as by soldering, to appropriate conductive pads or circuit traces on the respective printed circuit board to which the primary connector is mounted. The entire housing 122, including the interior of terminal-receiving cavities 126 and the exterior of board-engaging pads 144, is plated with conductive metal material for shielding and grounding purposes. Lastly, FIG. 12 best shows that housing 122 of the primary connector is formed with a grid of longitudinal and lateral grooves 146 which also are plated on the insides thereof with a conductive metal material.

Referring to FIGS. 17 and 18 in conjunction with FIG. 10, a plurality of signal terminals 148 are mounted in a plurality of terminal modules, generally designated 149 which, in turn, are mounted within a plurality of terminal-receiving cavities 150 through housing 124 of mating connector 116. FIG. 19 shows one of the terminal modules 149 which includes a dielectric body 152 mounting a pair of the terminals 148. FIG. 21 shows that each terminal 148 is a blade terminal having a chamfered or angled distal end 148a for engaging the contact ends 140 of terminals 138. As seen best in FIG. 20, dielectric body 152 has a pair of through holes 154 which mount terminals 148. The terminals are disposed in troughs 156 in opposite sides of a plug portion 158 of dielectric body 152. Therefore, the blade terminals are rigidly backed-up by the bottom walls of the troughs as can be seen clearly in FIG. 18. When connectors 114 and 116 are mated, plug portions 158 and terminals 148 (as best seen in FIGS. 17–19), are inserted into receptacles 134 of terminal modules 128 as seen best in FIGS. 12–14. Rigidly backed terminals 148 engage contact ends 140 of flexible terminals 138.

FIG. 10 shows that body 124 of mating connector 116 includes a grid of board-engaging pads 184 which, like primary connector 114, extend crosswise and lengthwise between all of the terminal modules 150. Again, signal terminals 148 and pads 184 extend from housing 124 so that they are coplanar for connection, as by soldering, to appropriate signal circuit traces and ground circuit traces on the printed circuit board.

Finally, FIGS. 17 and 18 best show that housing 124 of mating connector 116 includes a grid of interconnected ribs 186 which extend crosswise and lengthwise of the housing between and around terminal-receiving cavities 150 which receive terminal modules 149. The pattern of ribs 186 projecting from housing 124 of mating connector 116 is substantially identical to the pattern of grooves 146 in housing 122 of primary connector 114.

Housing 124 of mating connector 116 is plated with conductive metal material, including board-engaging pads 184 as well as ribs 186. Therefore, when housings 122 and 124 of primary and mating connectors 114 and 116, respectively, are mated as shown in FIGS. 10 and 11, ribs 186 of the mating connector interengage within grooves 146 of the primary connector with a press-fit in a type of tongue-and-groove configuration. With both of the connector housings, including the ribs and grooves, being plated with metal material, these complementary interengaging portions of the housings conductively common the shielding between both the first and second connectors through the entire connector assembly. With the plated housings being grounded to the mezzanine printed circuit boards through board-engaging pads 144 of the primary connector and pads 184 of the mating connector, a common ground extends between the parallel boards through the entire mated connector assembly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A shielded electrical connector for mounting on a printed circuit board, comprising:

a dielectric housing including a plurality of terminal-receiving cavities, the housing having top and bottom surfaces and opposing side surfaces, each of the housing cavities extending completely through the housing so that they open to the housing top and bottom surfaces, and a plurality of board-engaging members disposed along the bottom surface of said housing;

a plurality of terminal assemblies received in said housing cavities, and each of the terminal assemblies including a pair of conductive terminals and the terminals of each terminal assembly including tal portions that extend outwardly to sides of said housing, each of said board-engaging members being disposed between adjacent housing cavities, each of the board-engaging members extending transversely across said housing bottom surface between the opposing side surfaces of said housing, said board-engaging members supporting said housing above a circuit board and defining spaces between said housing bottom surface and a circuit board to which said housing is mounted, the terminal tail portions extending through said spaces when said housing is mounted to a circuit board; and, said housing being plated with conductive metal material to electrically shield the terminals in one terminal assembly from each other, the plating being continuous onto said board-engaging members for connection to appropriate ground ground circuits on the printed circuit board.

2. The shielded electrical connector of claim 1, wherein the entire interior of each of said housing cavities are plated with the conductive metal material, with the terminals being insulated therefrom.

3. The shielded electrical connector of claim 1, wherein said housing is molded of dielectric plastic material and said board-engaging members are molded integrally therewith.

4. The shielded electrical connector of claim 1, wherein said board-engaging members are configured for surface engaging the printed circuit board.

5. The shielded electrical connector of claim 4, wherein said terminal tail portions are formed for surface connection to appropriate circuits on the printed circuit board.

6. The shielded electrical connector of claim 1, wherein said terminal assemblies inlcude terminal modules, with the terminals mounted in respective dielectric blocks received in the terminal-receiving cavities of said housing.

7. A shielded electrical connector assembly, comprising:

a first shielded electrical connector including a first dielectric housing having a plurality of terminal-receiving cavities, a plurality of first terminals received in said cavities, and portions of said first housing between the terminals being plated with conductive metal material to electrically shield the terminals from each other;

a second shielded electrical connector including a second dielectric housing having a plurality of terminal-receiving cavities, a plurality of second terminals received in said cavities and mateable with said first terminals, and, portions of said second housing between the second terminals being plated with conductive metal material to electrically shield the terminals from each other; and complementary interengaging portions between said first and second housings of the first and second connectors, respectively, with the metal plating on the two housings being continuous onto the complementary interengaging portions to conductively common the shielding between both the first and second connectors, said complementary interenaging portions between the first and second housings comprise a tongue-and-groove structure and the tongue-and-groove structure including a network of ribs on one of the housings interengaging within grooves in the other of the housings.

8. The shielded electrical connector assembly of claim 7, wherein said interengaging ribs and grooves extend between the respective terminals of the two connectors.

9. The shielded electrical connector assembly of claim 7, wherein the interior of the terminal-receiving cavities in said dielectric housing of at least one of said connectors are plated with the conductive metal material, with the respective terminals being insulated therefrom.

10. The shielded electrical connector assembly of claim 9, further including a plurality of board-engaging pads disposed on the respective dielectric housing of at least one of said connectors and located between the respective terminal-receiving cavities of that connector.

11. The shielded electrical connector assembly of claim 10, wherein the dielectric housing of at least one of the connectors is molded of dielectric plastic material with the respective board-engaging pads of that housing being molded integrally therewith.

12. The shielded electrical connector assembly of claim 11 wherein substantially the entire dielectric housing of at least one of the connectors, including the respective board-engaging pads thereof, is plated with the conductive metal material, with the respective terminals being insulated therefrom.

13. The shielded electrical connector assembly of claim 7 wherein the dielectric housing of at least one of said connectors includes a plurality of board-engaging pads projecting from the bottom of the housing, with the plating of conductive metal material being continuous onto said pads for connection to appropriate ground circuit means on an appropriate printed circuit board.

14. The shielded electrical connector assembly of claim 13 wherein said board-engaging pads are configured for surface engaging the printed circuit board.

15. The shielded electrical connector assembly of claim 14 wherein the terminals of said at least one connector include portions adapted for surface connection to appropriate circuit means on the printed circuit board.

16. The shielded electrical connector assembly of claim 7 wherein the terminals of at least one of said connectors comprise elements of terminal modules, with those terminals mounted in respective dielectric bodies received in the terminal-receiving cavities of the housing of the at least one connector.

17. The shielded electrical connector assembly of claim 16 wherein substantially the entire interior of the terminal-receiving cavities in the housing of said at least one connector are plated with the conductive metal material.

18. The shielded electrical connector assembly of claim 7 wherein the housings of said first and second connectors include complementary interengaging latch means, with the plating of conductive metal material being continuous onto said latch means.

* * * * *